US011067310B2

(12) United States Patent
Glover, Jr.

(10) Patent No.: US 11,067,310 B2
(45) Date of Patent: Jul. 20, 2021

(54) TOPSIDE INDUCED DRAFT FAN

(71) Applicant: Edgar Glover, Jr., Mound Bayou, MS (US)

(72) Inventor: Edgar Glover, Jr., Mound Bayou, MS (US)

(73) Assignee: Edgar Glover, Jr., Mound Bayou, MS (US)

( * ) Notice: Subject to any disclaimer, the term of this patent is extended or adjusted under 35 U.S.C. 154(b) by 148 days.

(21) Appl. No.: 16/679,211

(22) Filed: Nov. 10, 2019

(65) Prior Publication Data

US 2020/0200436 A1 Jun. 25, 2020

Related U.S. Application Data

(63) Continuation-in-part of application No. 15/673,183, filed on Aug. 9, 2017, now abandoned.

(51) Int. Cl.

| | |
|---|---|
| ***F24H 9/00*** | (2006.01) |
| ***F23L 17/00*** | (2006.01) |
| ***F04D 25/12*** | (2006.01) |
| ***F04D 29/60*** | (2006.01) |
| ***F24H 3/08*** | (2006.01) |
| ***F04D 29/18*** | (2006.01) |
| ***F24H 9/20*** | (2006.01) |
| ***F24H 9/02*** | (2006.01) |

(52) U.S. Cl.

CPC ..... *F24H 9/0073* (2013.01); *F04D 25/12* (2013.01); *F04D 29/18* (2013.01); *F04D 29/601* (2013.01); *F23L 17/005* (2013.01); *F24H 3/087* (2013.01); *F24H 9/0052* (2013.01); *F24H 9/02* (2013.01); *F24H 9/2085* (2013.01)

(58) Field of Classification Search

CPC ..... F04D 17/16; F04D 17/165; F04D 17/168; F04D 25/12; F04D 29/162; F04D 29/18; F04D 29/601; F24H 3/06; F24H 3/065; F24H 3/087; F24H 9/0052; F24H 9/0073; F24H 9/0078; F24H 9/02; F24H 9/2085; F23L 17/005

See application file for complete search history.

(56) References Cited

U.S. PATENT DOCUMENTS 4,922,889 A * 5/1990 Nuesmeyer ..... F23B 1/30 126/73
5,570,680 A * 11/1996 Payne ..... F24H 8/006 126/113
5,826,520 A * 10/1998 Mainord ..... F23G 7/063 110/342
6,599,119 B1 * 7/2003 Wood ..... F23C 9/08 431/115

(Continued)

*Primary Examiner* — Ryan A Reis

(57) ABSTRACT

This concept is very new, and it will allow for safe and continuous operation of gas heating units when the induced draft fan no longer operates. This device will allow the HVAC service technician to continue to operate the gas heating unit until the proper replacement induced draft fan can be acquired and installed on the gas heating unit. This invention is a supplemental induced draft fan that will attach to the exhaust output side of a gas heating units inoperable induced draft fan to draft air through the heat exchanger and create a vacuum to the pressure switch at a rate to be regulated by a control switch to make the gas heating unit operate safely until the correct part is acquired and installed.

1 Claim, 10 Drawing Sheets

(56) References Cited

U.S. PATENT DOCUMENTS

2001/0038794 A1* 11/2001 Stewart ..... F23L 17/005
417/53
2012/0083194 A1* 4/2012 Hagensen ..... F23J 11/02
454/16

* cited by examiner

TOPSIDE INDUCED DRAFT FAN

BACKGROUND OF THE INVENTION

This device was developed and the idea for its' operation was formed to give the HVAC service tech the ability to allow a gas heating unit to continue to operate safely when the induced draft fan is inoperable, until the correct induced draft fan is acquired and installed on the gas heating unit. Usually, the induced draft fan would have to be replaced to safely operate the gas heating unit and sometimes it may take several days to acquire the correct model needed.

BRIEF SUMMARY OF THE INVENTION

This device is designed to adjust the vacuum pressure through the inoperable induced draft fan to close the pressure switch and regulate the draft flow through the heat exchanger that will initiate startup and allow the gas heating unit to operate safely without having to immediately replace the units induce draft fan.

BRIEF DESCRIPTION OF SEVERAL VIEWS OF DRAWINGS

Figure 1:
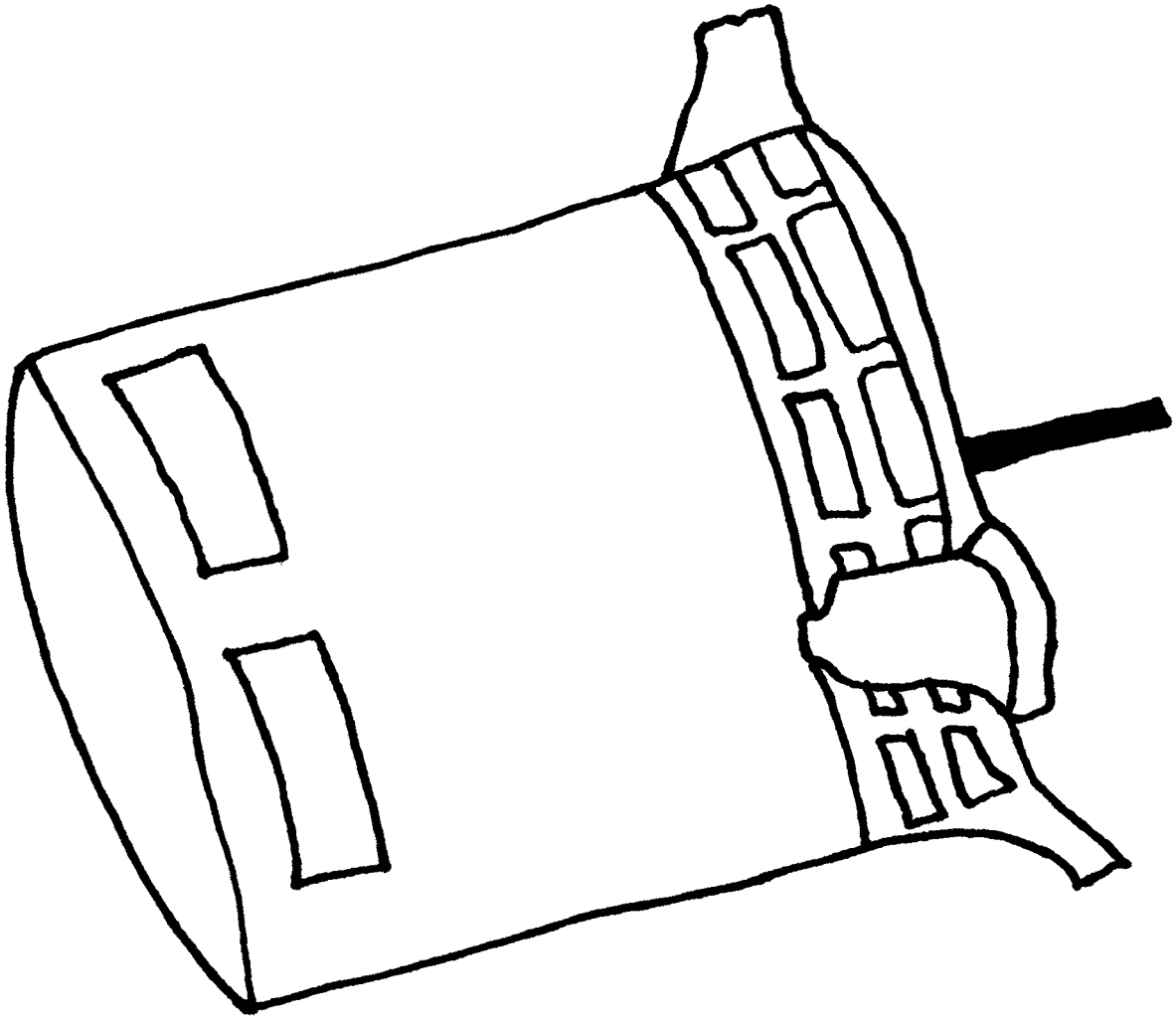

FIG. 1 Drawing of the motor that will be installed onto the housing for the blower side of the device.

Figure 2:
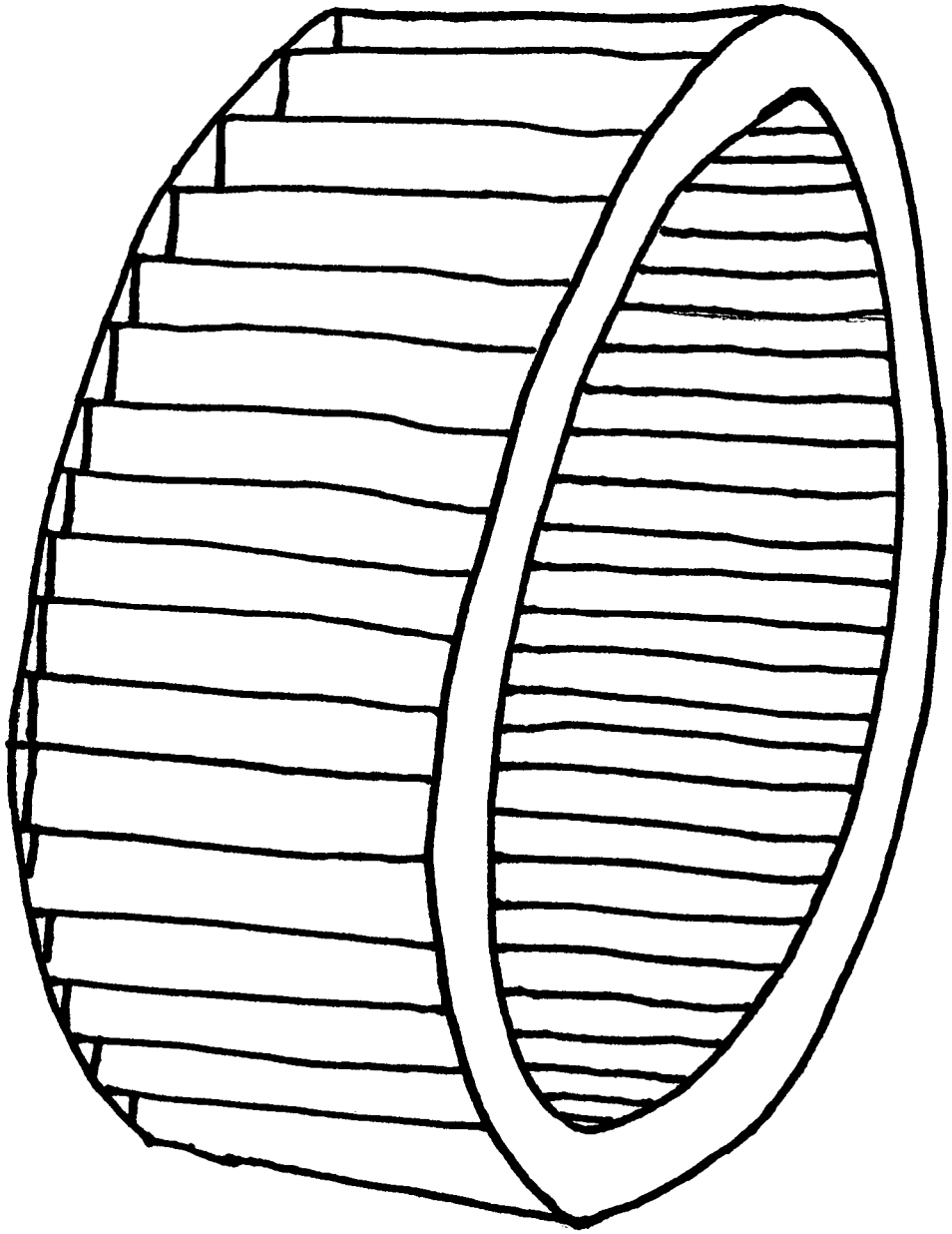

FIG. 2 Drawing of the squirrel cage type blower wheel that will be installed in the device to move the air.

Figure 3:
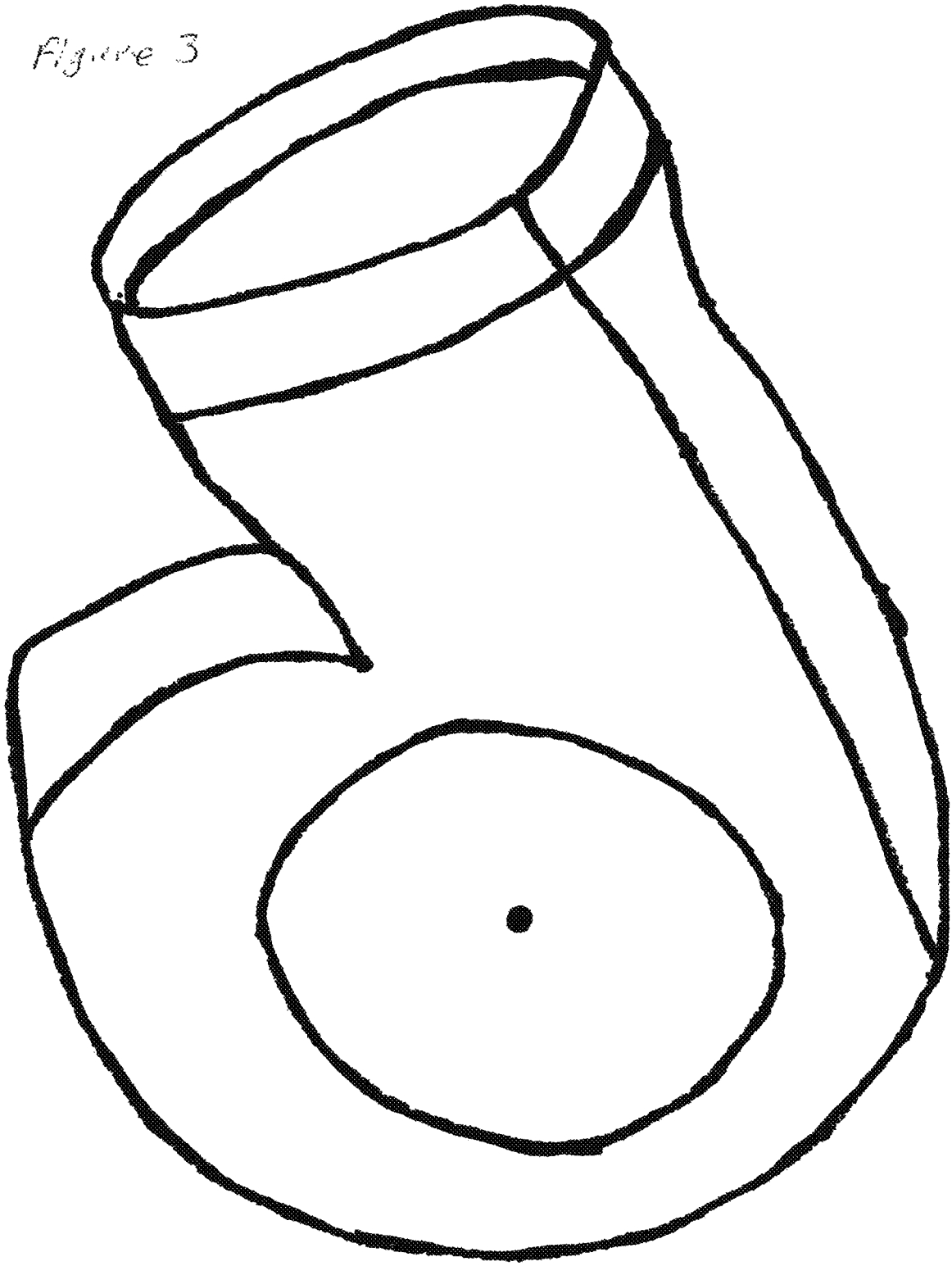

FIG. 3 Drawing of the open side view of the blower housing that the motor and blower wheel to be installed.

Figure 4:
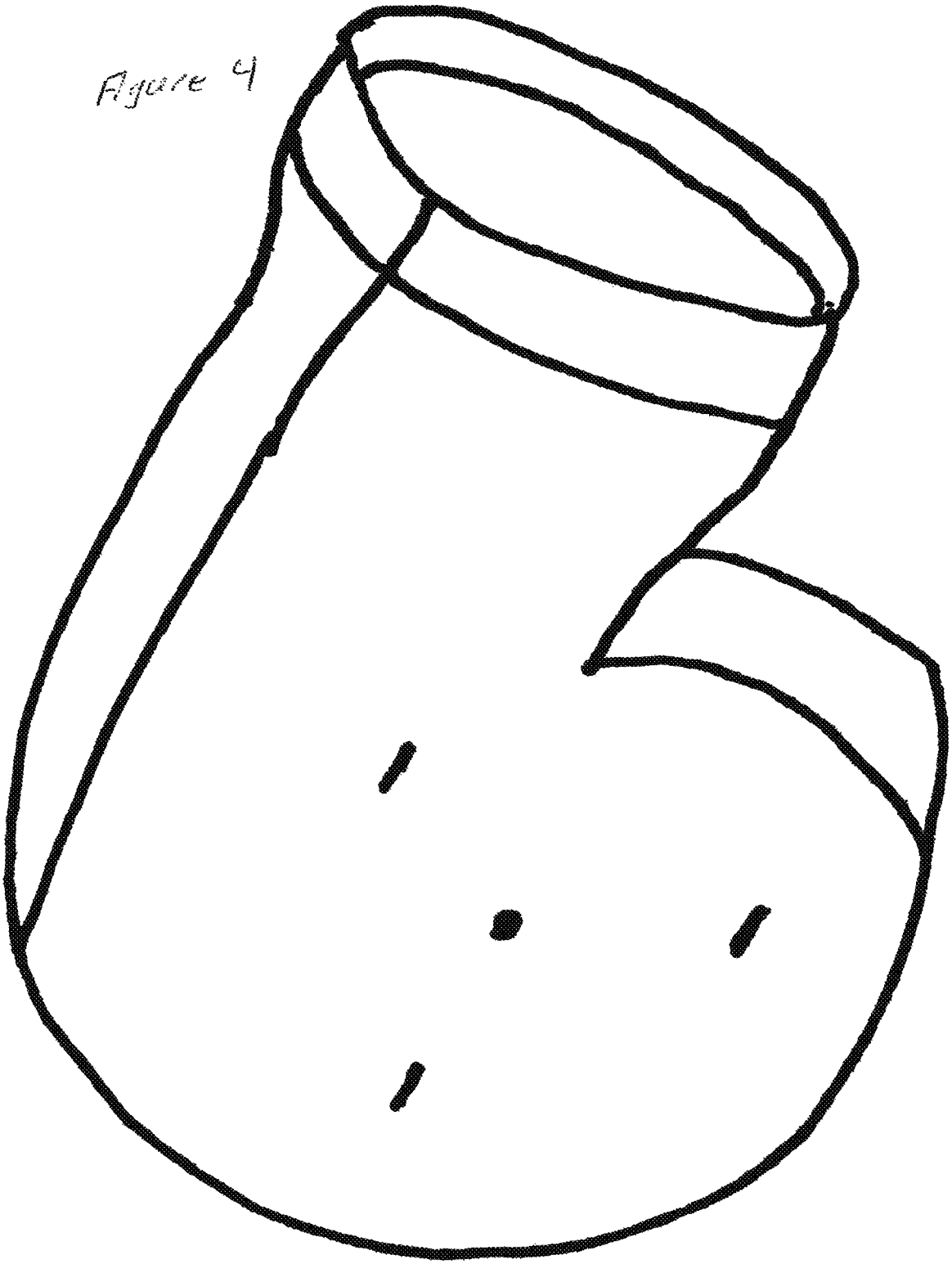

FIG. 4 Drawing of the back-side view of the blower housing

Figure 5:
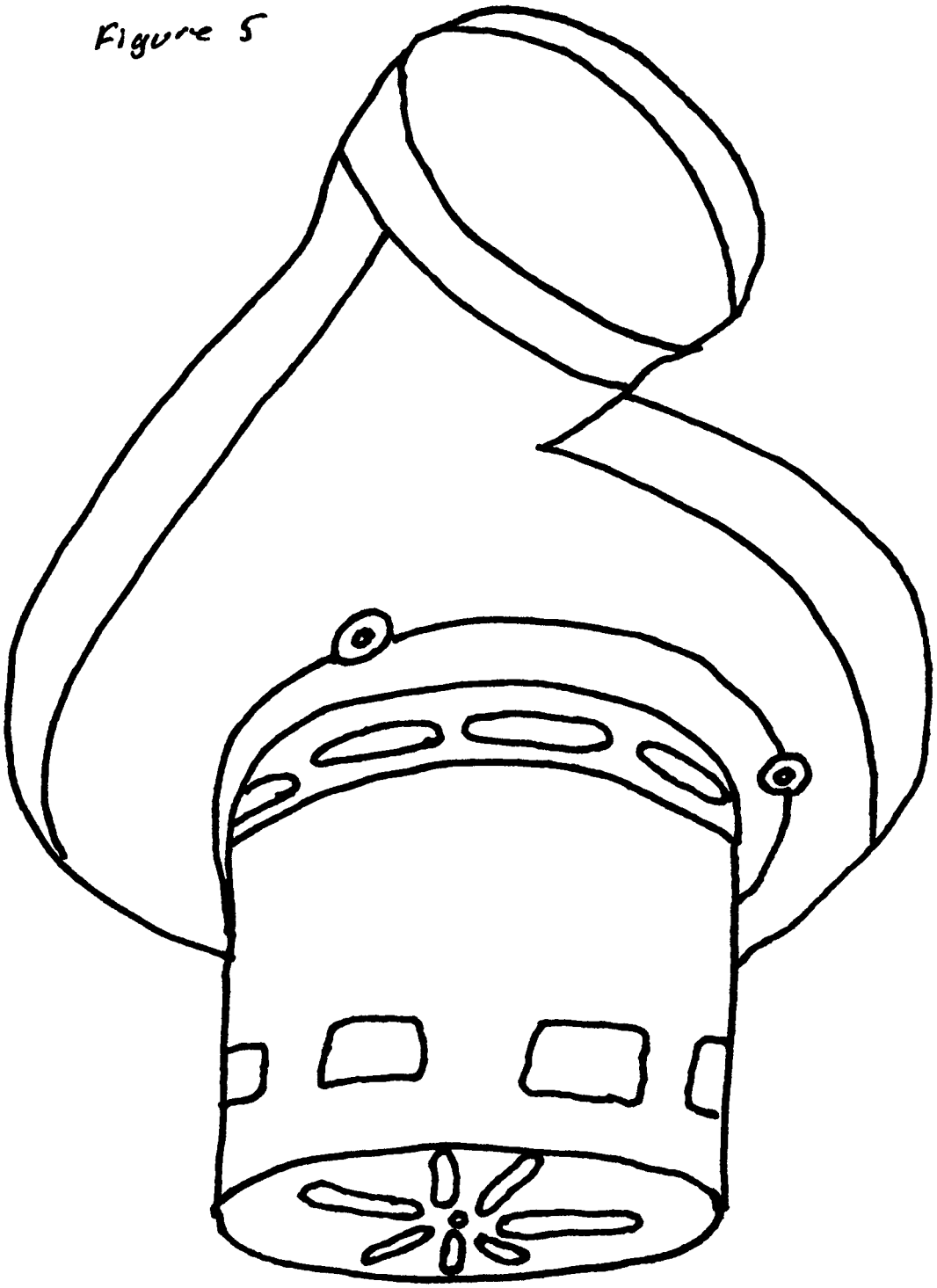

FIG. 5 Drawing of the motor side of the blower housing assembly of the device.

Figure 6:
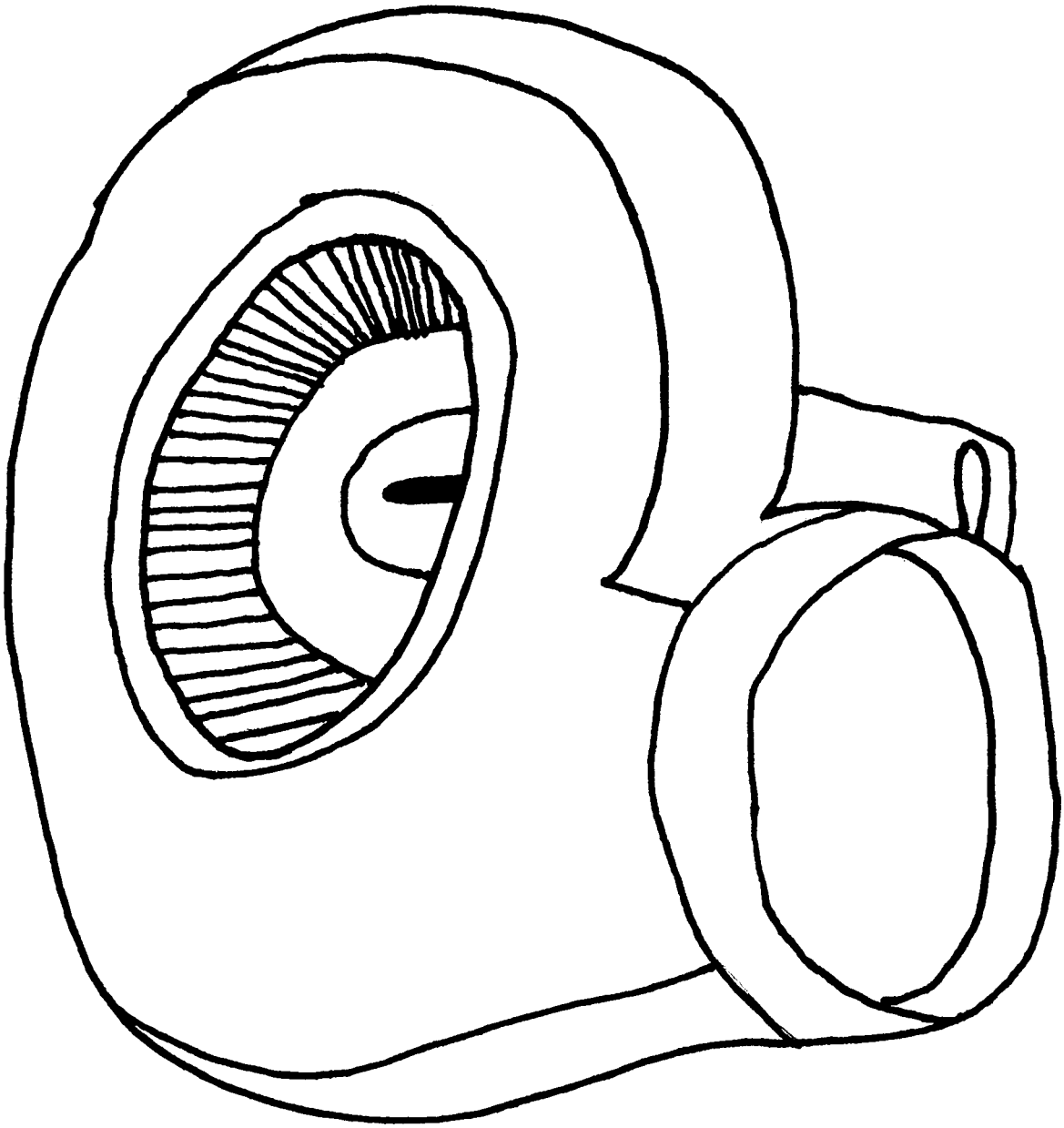

FIG. 6 Drawing of the open side view of the blower housing assembly of the device showing the blower wheel.

Figure 7:
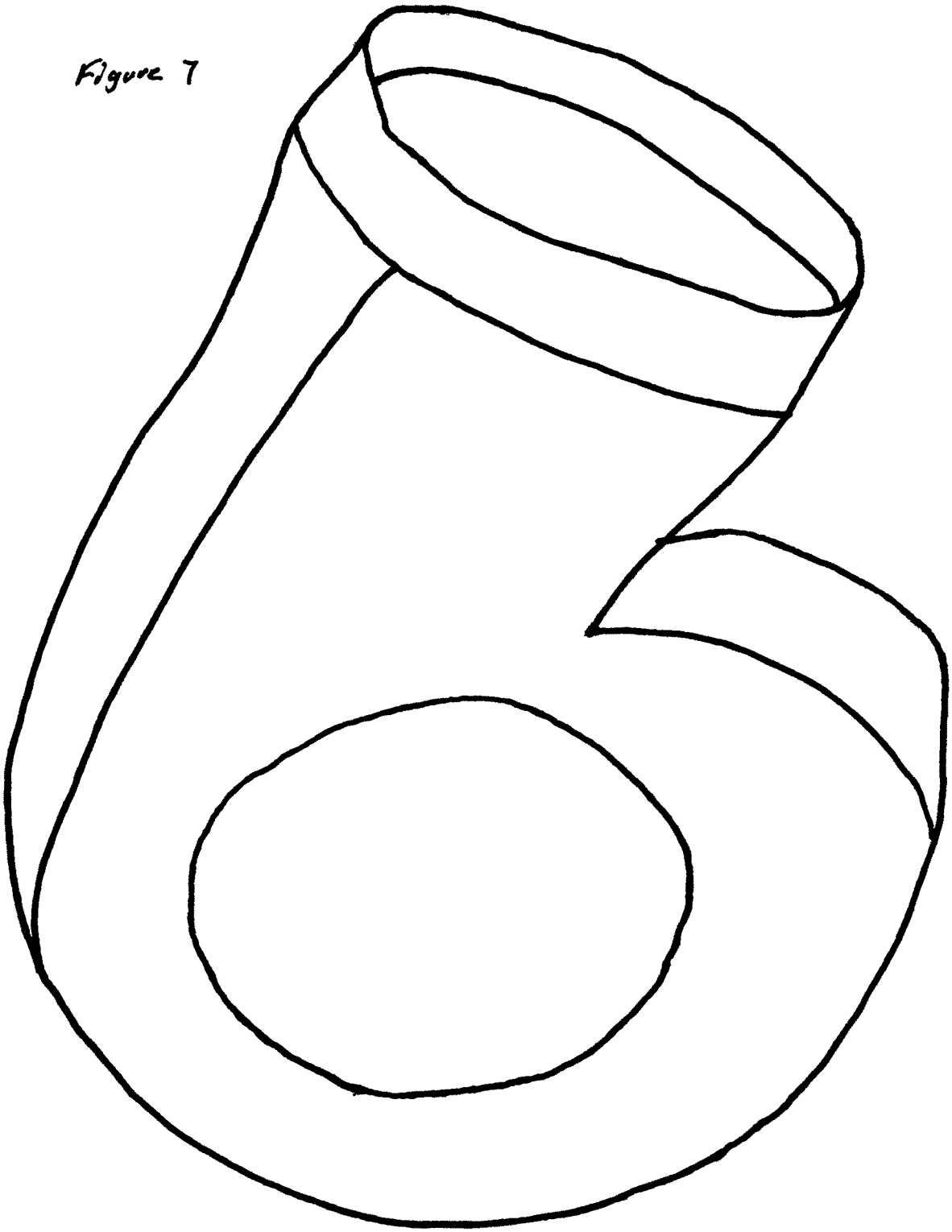

FIG. 7 Drawing of the open side view of the intake housing of the device.

Figure 8:
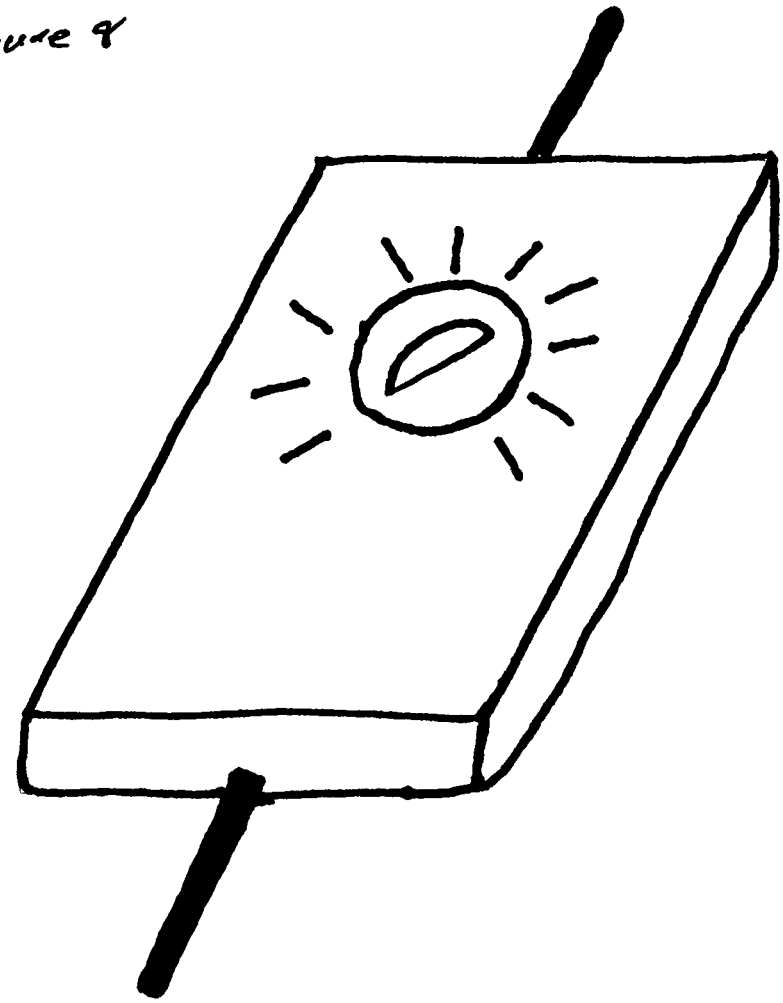

FIG. 8 Drawing of the motor speed control switch.

Figure 9:
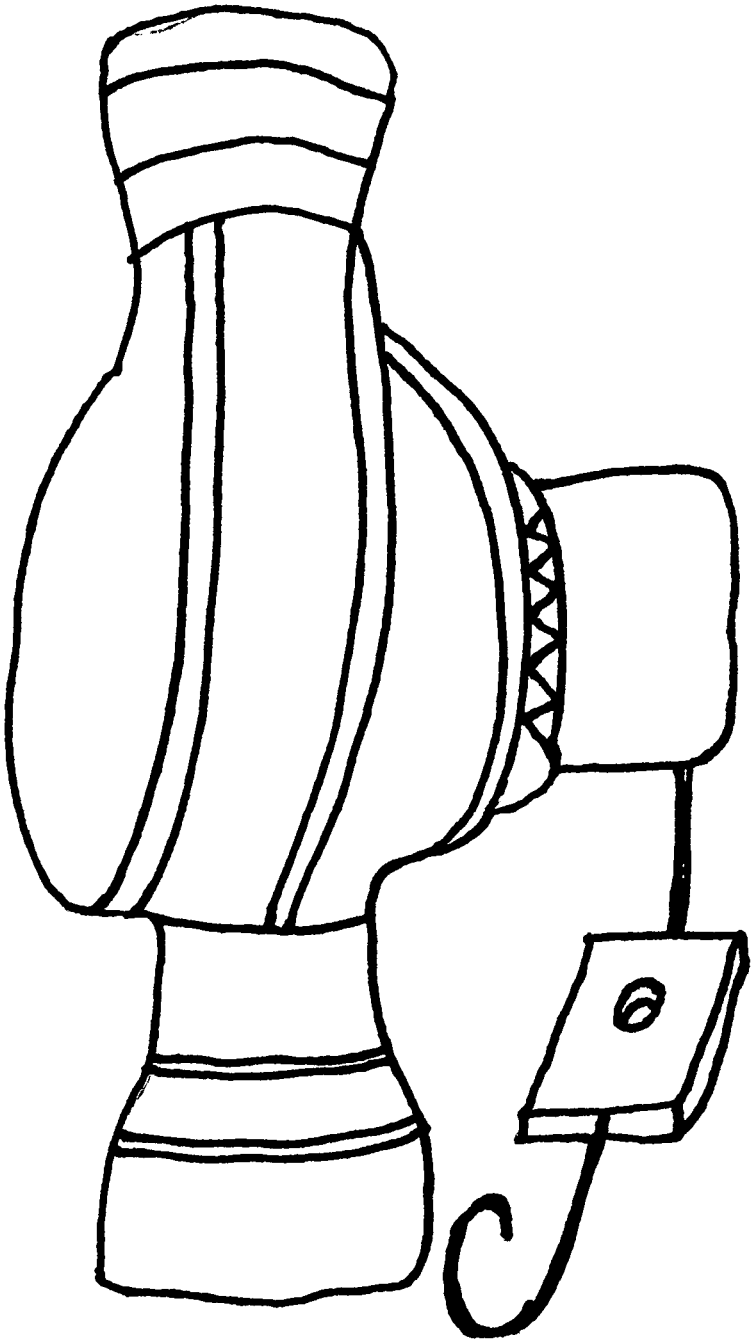

FIG. 9 Drawing of the entire Topside Induced Draft device showing the motor speed control switch inline.

Figure 10:
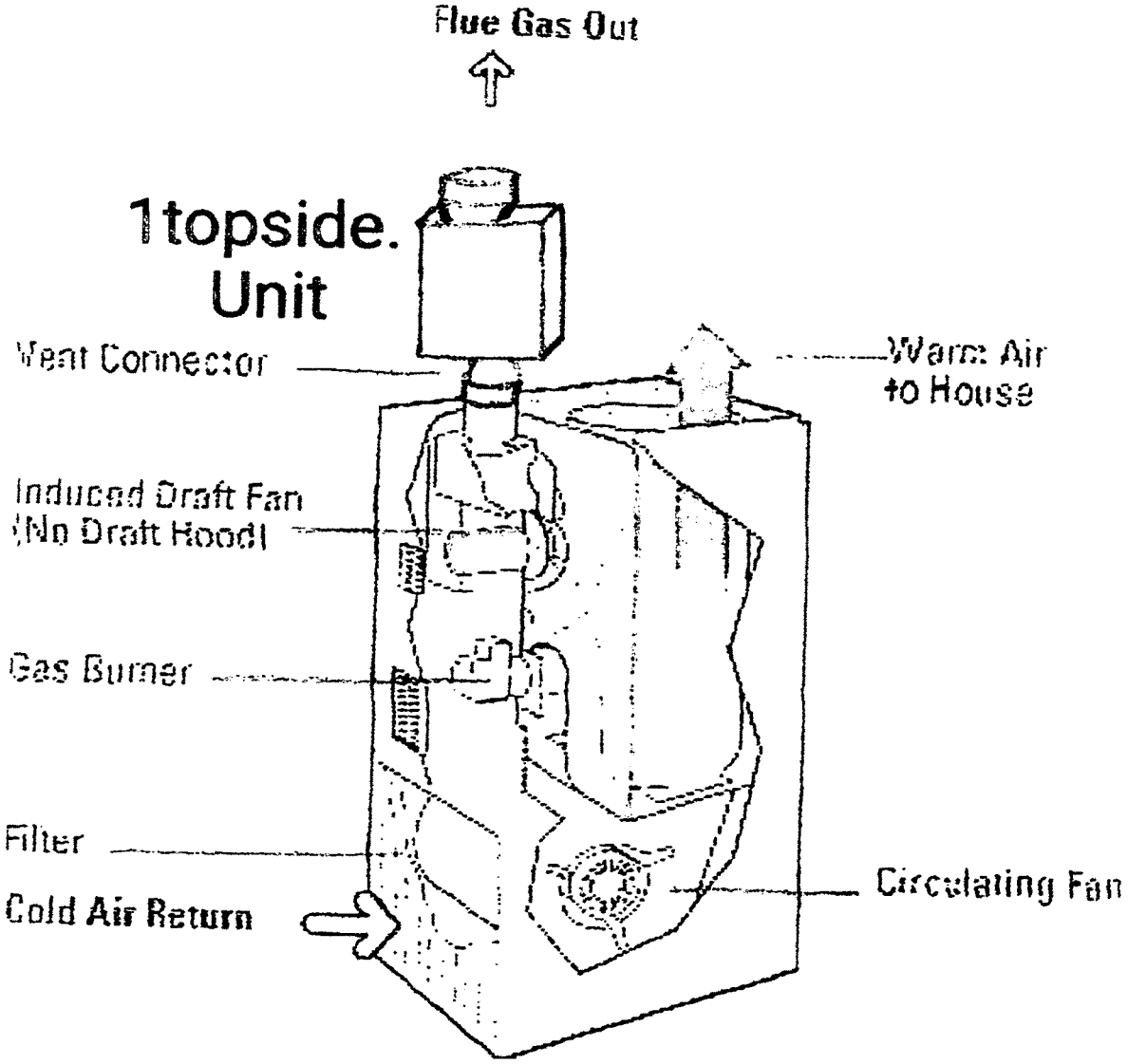

FIG. 10 Drawing of the Topside Induced Draft device installed onto a heating unit.

DETAILED DESCRIPTION

The first step in assembling this device is to assemble the three parts that makeup the FIG. 5 blower housing assembly. Insert the shaft of FIG. 1 motor through the small opening located on the topside of the FIG. 4 blower housing. Align the mounting holes on the motor through the studs and secure the FIG. 1 motor to the FIG. 4 blower housing. Install the FIG. 2 blower wheel into the FIG. 4 blower housing, mount the center of the FIG. 2 blower wheel onto the FIG. 1 motor shaft and tighten down with the set of screws, making sure the FIG. 2 blower wheel can spin freely. This blower assembly is used to construct FIG. 5 blower housing assembly. Mount and seal FIG. 7 intake housing with the airshaft in the downward position, onto the FIG. 5 blower housing assembly with the air shaft in the upward position to complete FIG. 9 Topside Induced Draft Fan.

Remove the exhaust pipe from the gas heating unit and place the topside induce draft fan in its place, which will be directly in the exhaust stream to induce negative pressure into the heat exchanger. Reinstall the exhaust pipe onto the out-flow exhaust side of the topside induce draft fan, making sure the exhaust pipes are installed correctly. Unplug the old induced draft fan's electrical supply and use that voltage to power the topside induce draft fan. Using a tee connection and install it on the pressure switch vacuum hose to gauge the vacuum pressure to the pressure switch from the inoperable induced draft fan, that has been calibrated to that gas heating unit, with a magnehelic gauge. When the gas heating unit is turned on, vacuum pressure is created and adjusted with the control switch to the specified water column for that heating unit that's listed on the pressure switch. There is no certain type or brand of motor control switch that can be incorporated with this device. Motor control switch that have the rated capabilities in range with the motor will be used with this device. For our prototype, we use Leviton brand fan speed control, 120-volt, 5-amp rating. The motor used is a Rotom brand, 115-volt, 1.7 amp, 1/20 hp at 3400 RPM. Our prototype measures 15.5 inches high and 9 inches wide which allows it to fit well in the small space its designed for. By using the control switch to regulate the vacuum pressure and draft flow through the non-operating induced draft fan, closing the pressure switch, which will send voltage to the igniter causing it to heat up, the gas regulator valve will open to release gas to the burner and the gas heating unit will light. The chamber opening at the intake housing that seals to the blower housing assembly is cut to the same diameter as the blower wheel which allows it to pull the maximum amount of air flow through this device. Induced draft fans are pulling approximately 0.5 to 0.7 water columns above what's listed on the pressure switch, having this control switch to adjust the vacuum pressure is an important feature. A combustion analyzer can then be used to check the exhaust for complete combustion, making sure that the byproducts of combustion are at the recommended levels. This topside induce draft fan is utilizing the old draft induced fan's power source, pulling the vacuum and drafting the exhaust in the same manner the old induce draft fan was intended to. The only thing disconnected and reconnected on the gas heating unit is the power to the unit's induced draft fan and raising the exhaust pipe off the gas heating unit, installing the topside induce draft fan on the exhaust side of the unit's induced draft fan and reinstalling the exhaust pipes on the exhaust out flow side of the topside induced draft fan.

This topside induced draft fan is constructed basically from aluminum and steel, the same material that all other induced draft fans are made from. The topside unit is designed with an intake that will create negative pressure inside of a gas heating unit by pulling air through the non-operating induced draft fan which will allow the service technicians not to have to remove the old induced draft fan until the replacement is ready to be installed. The topside induced draft fan is designed to fit directly in the exhaust stream on gas heating units and will operate very efficiently on all gas heating units that depends on induced draft.

The topside induced draft fan will allow the heating unit to operate safely without having to bypass any component or safety devices on the heating unit. The topside unit is universally designed to fit any heating unit and when properly installed, will allow for safe and continued operation of the gas heating unit.

The invention claimed is:

1. A method comprising:

providing a topside induced draft fan having a motor connected to a squirrel cage impeller, the topside induced draft fan having an inlet opening at one end and an outlet opening at an opposite end such that the inlet opening and outlet opening have parallel axes;

attaching the inlet opening to an exhaust opening of a gas heating unit when an induced draft fan of the gas heating unit is inoperable;

attaching the outlet opening to a flue to exhaust air to atmosphere; and operating the motor using a control switch to regulate a vacuum in the gas heating unit to close a pressure switch to reignite a burner in the gas heating unit.

* * * * *